US006478589B2

(12) United States Patent
Robinson et al.

(10) Patent No.: US 6,478,589 B2
(45) Date of Patent: Nov. 12, 2002

(54) ELECTRICAL SERVICE APPARATUS SAFETY SHIELD WITH WIRE GUIDES

(75) Inventors: Darrell Robinson, Highland Township, MI (US); Allen V. Pruehs, Howell, MI (US)

(73) Assignee: Ekstrom Industries, Inc., Farmington Hills, MI (US)

( * ) Notice: Subject to any disclaimer, the term of this patent is extended or adjusted under 35 U.S.C. 154(b) by 0 days.

(21) Appl. No.: 09/773,064

(22) Filed: Jan. 31, 2001

(65) Prior Publication Data

US 2002/0102873 A1 Aug. 1, 2002

(51) Int. Cl.[7] ..... H01R 13/44

(52) U.S. Cl. ..... 439/146; 361/659; 361/1; 429/135

(58) Field of Search ..... 439/146, 149, 439/501, 508, 523, 749, 4, 135; 361/659–669

(56) References Cited

U.S. PATENT DOCUMENTS

| | | | | |
|---|---|---|---|---|
| 1,645,539 A | | 10/1927 | Mau | 439/866 |
| 3,061,763 A | | 10/1962 | Ekstrom | 361/669 |
| 3,221,216 A | | 11/1965 | Kobryner | 361/704 |
| 3,662,224 A | | 5/1972 | Rauch | 361/741 |
| 4,127,924 A | | 12/1978 | Koss | 29/413 |
| 4,412,714 A | | 11/1983 | Morningstart et al. | 439/352 |
| 4,772,213 A | | 9/1988 | Bell et al. | 439/135 |
| 4,892,485 A | | 1/1990 | Patton | 439/135 |
| 5,023,747 A | | 6/1991 | Lindsay | 361/117 |
| 5,068,962 A | | 12/1991 | Germer et al. | 29/830 |
| 5,088,004 A | | 2/1992 | Howell | 361/373 |
| 5,145,403 A | | 9/1992 | Schaffert et al. | 439/508 |
| RE34,531 E | | 2/1994 | Bell et al. | 439/135 |
| 5,423,695 A | | 6/1995 | Robinson et al. | 439/517 |
| 5,571,031 A | | 11/1996 | Robinson et al. | 439/517 |
| 5,572,386 A | * | 11/1996 | Ananth et al. | 360/103 |
| 5,577,933 A | | 11/1996 | Robinson et al. | 439/517 |
| 5,586,913 A | | 12/1996 | Robinson et al. | 439/638 |
| 5,704,804 A | | 1/1998 | Robinson et al. | 439/517 |
| 6,081,180 A | * | 6/2000 | Fernandez et al. | 336/90 |
| 6,152,764 A | * | 11/2000 | Robinson et al. | 439/517 |
| 6,325,666 B1 | * | 12/2001 | Robinson et al. | 439/517 |

OTHER PUBLICATIONS

Marwell socket adapter with internal wire clips and Edco telephone connection by Liebert Corp., Model No. FAS–TEL–200T.

* cited by examiner

*Primary Examiner*—Gary F. Paumen
*Assistant Examiner*—James R. Harvey
(74) *Attorney, Agent, or Firm*—Young & Basile, PC

(57) ABSTRACT

A safety shield for an electrical service apparatus is in the form of an enclosure surrounding in the apparatus jaw contacts. Latch members formed on the shield releasibly engage apertures in the apparatus housing to mount the shield in the housing. The latch members are configured to fill the apertures in the housing to prevent disengagement of the shield from the housing during removal of a watthour meter from the housing. In one aspect, the shield is provided with wire wrap members for winding up lengths of excess cables and conductors extending from a watthour meter. The wire wrap members include a pair of arms arranged about the periphery of the shield or spaced flanges on opposite sides of the shield. The wire wrap members also include a flange having an end extending over an aperture in the shield which acts as a strain relief for a conductor extending through the shield. In another aspect, a light transmissive guide carried on the shield transmits light generated by a light generating source within the housing to a visible location externally of the housing.

50 Claims, 9 Drawing Sheets

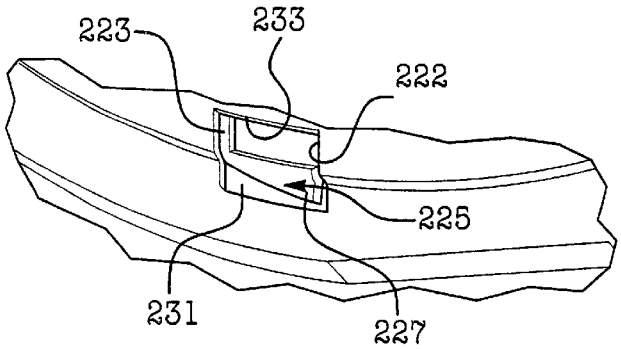
Figure 12C
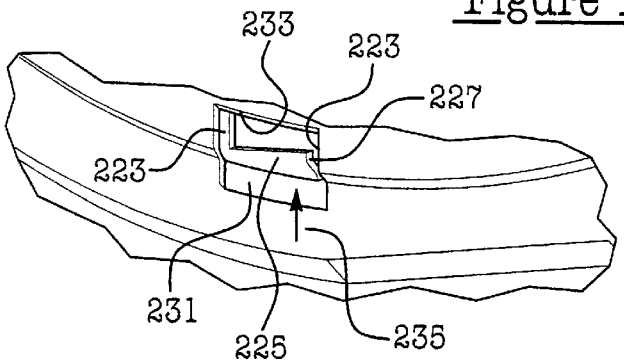
Figure 12D
Figure 13
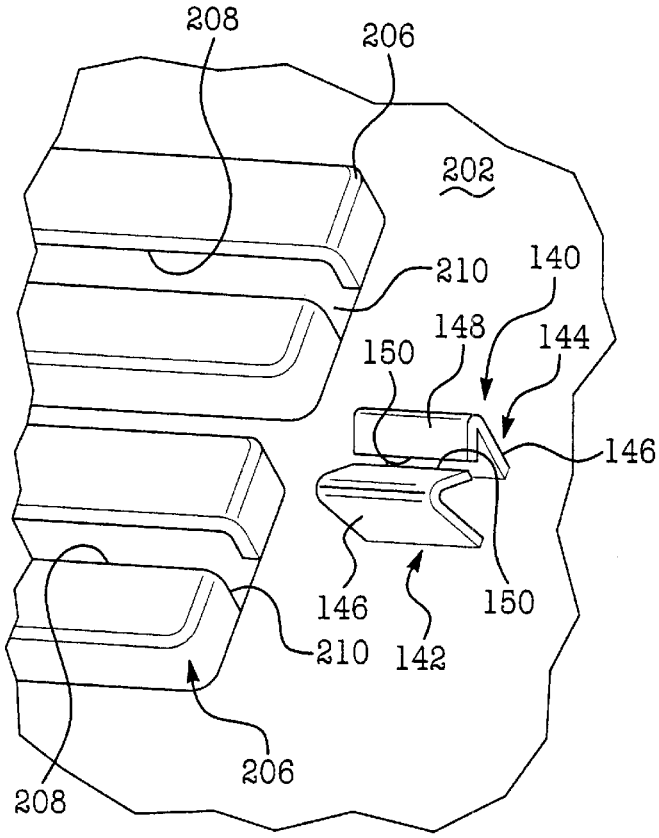

ELECTRICAL SERVICE APPARATUS SAFETY SHIELD WITH WIRE GUIDES

BACKGROUND

1. Field of the Invention

The present invention relates, in general, to electrical power service to homes and buildings and, more specifically, to watthour meters, meter sockets and watthour meter socket adapters.

2. Description of the Art

Electrical power is supplied to an individual site or service by electrical power line conductors located above or below ground. In a conventional arrangement, electrical power line conductors are connected to contacts in a watthour meter socket mounted on a building wall. Electrical load conductors are connected to another set of contacts in the meter socket and extend to the electrical distribution network in the building. A watthour meter, typically of the plug-in, socket type, is connected to the contacts in the meter socket to measure the electrical power drawn through the load conductors.

Plug-in watthour meter socket adapters and socket adapters/extenders, both hereafter referred to simply as socket adapters, are designed to plug into the meter socket housing contacts. Such socket adapters are employed to convert ringless style sockets to ring style sockets or to extend the mounting position of the jaw terminals in the socket housing outward from the socket housing for mounting various electrical equipment, such as test devices or survey recorders, in the socket housing.

Such socket adapters employ a generally annular base having a shell joined thereto and extending outward from one side of the base. Contacts are mounted in the shell and base. Each contact has a female jaw portion disposed interiorly within the shell and a male blade terminal connected to the female jaw portion and extending outward from the shell and the base for a plug-in connection to the terminals in the meter socket housing.

While it is typical for a watthour meter, once it is installed in a socket or socket and socket adapter, to remain in service for many years, it is still necessary for such meters to be removed for repair or replacement from time to time as well as to temporarily disconnect electrical service to a particular customer. During the installation and removal of the watthour meter from the socket or socket adapter, the electric power line terminals in the socket or socket adapter remain connected to the electric utility power line conductors and carry potential. The utility employee installing or removing the watthour meter may inadvertently touch such contacts thereby raising the possibility of injury. Furthermore, an inadvertent short across the contacts caused by a tool contacting the contacts or a full fault caused by a 90° offset insertion of the meter can cause a spark or flash which could damage the watthour meter installation as well as posing a significant risk of injury to the utility employee.

In U.S. Pat. No. 5,577,933, a unique safety shield for a watthour meter mounting apparatus is disclosed which completely covers all of the exposed portions of the jaw contacts to prevent inadvertent contact with such contacts by the utility employee or by a tool.

One embodiment of this safety shield is in the form of a housing having a unitary sidewall and top wall defining a closed body with an internal recess surrounding the jaw contacts. Narrow apertures or slots are formed in the top wall for receiving the blade terminals of a watthour meter therethrough into engagement with jaw contacts disposed immediately below each aperture in the top wall of the safety shield. In another embodiment, a plurality of receptacles extend from a planar wall mountable in the socket adapter, with each receptacle having one or more slots for receiving the meter blade terminals therethrough. The individual receptacles are sized to completely surround at least one jaw contact in the socket adapter.

Improved versions of Applicants' safety shield as shown in U.S. Pat. Nos. 5,572,386 and 5,577,933 and co-pending patent applications Ser. No. 09/291,885 filed Apr. 14, 1999. These safety shields have been designed for a snap in connection to the socket adapter base by means of legs having clip end portions which snap through apertures formed in the base wall of the socket adapter housing.

While such safety shields simplify the assembly of the safety shield in the socket adapter and reduce costs by eliminating separate fasteners previously used to mount safety shields in a socket adapter, it is possible that the removal of a watthour meter from the jaw contacts in a socket adapter could cause the safety shield to disengage from the socket adapter housing thereby exposing the jaw contacts in the socket adapter housing which are connected to the live line jaws in the meter socket. What is needed is a safety shield for a watthour meter socket adapter which resists separation from the socket adapter housing upon watthour meter removal from the socket adapter.

In another aspect of watthour meter usage, watthour meters are frequently provided with three to four foot long cables or conductors for telephone and other communication signals. The cables extend outwardly from the watthour meter and must be carefully placed within the socket adapter housing away from the watthour meter jaws so as not to be pinched or broken by the watthour meter blades upon insertion of the watthour meter blade into the socket adapter jaws or between the watthour meter feet and the bottom wall of the socket adapter housing.

One prior art approach employs a plurality of snap clips mounted by screws to the sidewall of the socket adapter housing, typically near the joint between the sidewall and the base of the socket adapter housing. The watthour meter cables are wound behind the snap clips in a circle about the inner periphery of the sidewall. Even though this apparatus has the added cost of mounting three or four snap clips within the socket adapter housing, it does provide storage of the watthour meter cables where the socket adapter housing has a standard 2½ inch sidewall depth.

However, the low profile socket adapter housing pioneered by the Assignee of the present invention has a significantly shorter or reduced sidewall height which limits space within the interior of the socket adapter housing for wire storage.

The actual telephone connection from the watthour meter cable to an external telephone line are made through a telephone connector, such as a telephone line connector sold under the trademark EDCO by Liebert Corp., Model No. FAS-TEL-200T. This connector also provides telephone line surge suppression. One or more standard telephone jacks are mounted at one side portion of this telephone connector. A second telephone jack along an opposite side edge of the connector is capable of receiving the telephone jack on the end of the watthour meter cable. Typically, the second jack is prewired to separate ring and line terminals within the connector.

Thus, it would be desirable to provide a safety shield for use in a watthour meter socket adapter and/or meter socket which is easy to use, includes integral wire wrap means, is suitable for use in all types of socket adapters including low-profile socket adapters, and provides a simple telephone connector and telephone line connections.

SUMMARY OF THE INVENTION

The present invention is an improved electrical service apparatus safety shield.

The safety shield of the present invention provides several unique advantages not found in previously devised electrical service apparatus or watthour meter safety shields. First, the safety shield for the present invention is uniquely formed with mounting legs to provide a secure snap-in connection of the safety shield to an electrical service apparatus, such as a watthour meter socket adapter, which resists dislodgement of the safety shield upon removal watthour meter from the socket adapter. The safety shield also provides integral wire wrap means for convenient, easy-to-use storage of watthour meter communication cables and for other conductors extending from the watthour meter. This integral mounting of the wire wrap means on the safety shield reduces assembly time and manufacturing costs of a watthour meter socket adapter as the separate spring clips employed in prior art socket adapters are eliminated. Finally, the safety shield of the present invention has a low height thereby enabling it to be used in a low-profile socket adapter while still providing the easy wire wrap and telephone interconnection features In one aspect, the safety shield is an electrically insulating shield for covering substantially all of the exposed portions of the electrical contacts within the housing of the watthour meter socket or socket adapter, the shield having apertures alignable with at least one electrical contact for receiving a blade terminal of a watthour meter therethrough in engagement with the one electrical contact. Preferably, four mounting legs are provided on the shield, each releasibly engaged with edges of an aperture in the socket adapter housing. Latch members are mounted on the end of each leg and non-movably latch through one aperture to the housing to prevent disengagement of the safety shield from the socket adapter during removal of the watthour meter from the socket adapter.

Each latch member is in the form of L-shaped clip having first and second angularly disposed sides which non-movably fill one aperture in the housing.

In another aspect of the invention, the safety shield carries wire wrap members for receiving cables and conductors extending from a watthour meter. The wire wrap members are arranged in at least one pair and, preferably, a plurality of pairs in the spaced locations about the safety shield.

In a specific aspect, the wire wrap members include a first leg extending outward from the shield, a second leg extending angularly from one end of the first leg and terminating in a tip. The tip is spaced from the edge of the shield to define an opening within the first and second legs and the shield for receiving a wire therein. Preferably, the tip end is disposed at an angle from the second leg to aid in retaining the wound cables and conductors within the arm.

In another specific aspect, the wire wrap members two spaced flanges extending outwardly from opposite sides of the shield. Preferably two flanges are carried on the shield, one between each pair of arms.

In yet another specific aspect, the wire wrap members include an aperture formed in the socket adapter housing and a clip carried on the shield and having an end portion cantilevered over the aperture, the center clip and functioning as a strain relief for a wire extending through the aperture in the shield.

In yet another aspect, the shield includes a light transmissive means or guide having first and second ends, the first end adapted to be disposed in proximity with a light generating source within the socket adapter to transmit light generated by the light generating source to the second end, the second being end disposed in a visible position to make the light visible externally of the socket adapter housing. Preferably, the second end of the light transmissive means is disposed through or visible through an aperture in the sidewall of the socket adapter housing.

The improved safety shield of the present invention adds new functionality to electrical service apparatus safety shields. In addition to providing the basic insulating protection for the service apparatus jaw contacts, the safety shield of the present invention also is provided with unique latch members which resist separation of the safety shield from the service apparatus or socket adapter housing during the removal of a watthour meter from the socket adapter. At the same time, the latch members can still be disengaged from the rear of the socket adapter to remove the safety shield from the socket adapter after the socket adapter is disengaged from the meter socket.

The unique provision of wire wrap members directly on the safety shield provides a simple and inexpensive wire wrap capability for conductors and cables attached to watthour meters in a simple and inexpensive manner. As the wire wrap members are carried directly on the shield, the need for separate mounting of spring clips and fasteners at various locations within the socket adapter housing is eliminated. Further, the position of the wire wrap members on the safety shield ensures that the wound cables and conductors are disposed in the non-interfering locations with respect to the watthour meter blade terminals and the watthour meter feet to prevent any damage to or breakage of the conductors and cables.

The provision of a unique light transmissive means or guide on the safety shield of the present invention uniquely enables light generated by a light generating source, such as an LED, in a functional circuit mountable within the socket adapter, to be transmitted to a more easily visible position, such as externally of the socket adapter. This enables the function indicated by the light generating source to be easily detected exteriorly of the socket adapter without requiring removal of the socket adapter from the watthour meter socket.

BRIEF DESCRIPTION OF THE DRAWINGS

The various features, advantages, and other uses of the present invention will become more apparent by referring to the following detailed description and drawing in which:

FIG. 12C is a partial, enlarged, perspective view of one latch projection of the safety shield depicted in the fully latched position;

FIG. 12D is a partial, enlarged, perspective view of one latch projection in a partial, unlatched position;

FIG. 13 is a partial, enlarged, perspective view of an alternate wire wrap means according to the present invention;

DETAILED DESCRIPTION

In order to better describe and appreciate the advantages of the present invention, a description of the construction of an electric service apparatus in the form of a watthour meter socket adapter or socket extender/adapter, both hereafter referred to as a socket adapter 10, will be provided with reference to FIGS. 1–9. It will be understood that the term "electrical service apparatus" as used in connection with the present invention means any type of apparatus used to provide, monitor or control electrical power to a use site. Thus, although the following description of the use of the safety shield of the present invention is in connection with a watthour meter socket adapter, it will be understood that the present safety shield is usable in any electrical service apparatus, including watthour meter sockets, etc.

Figure 1:
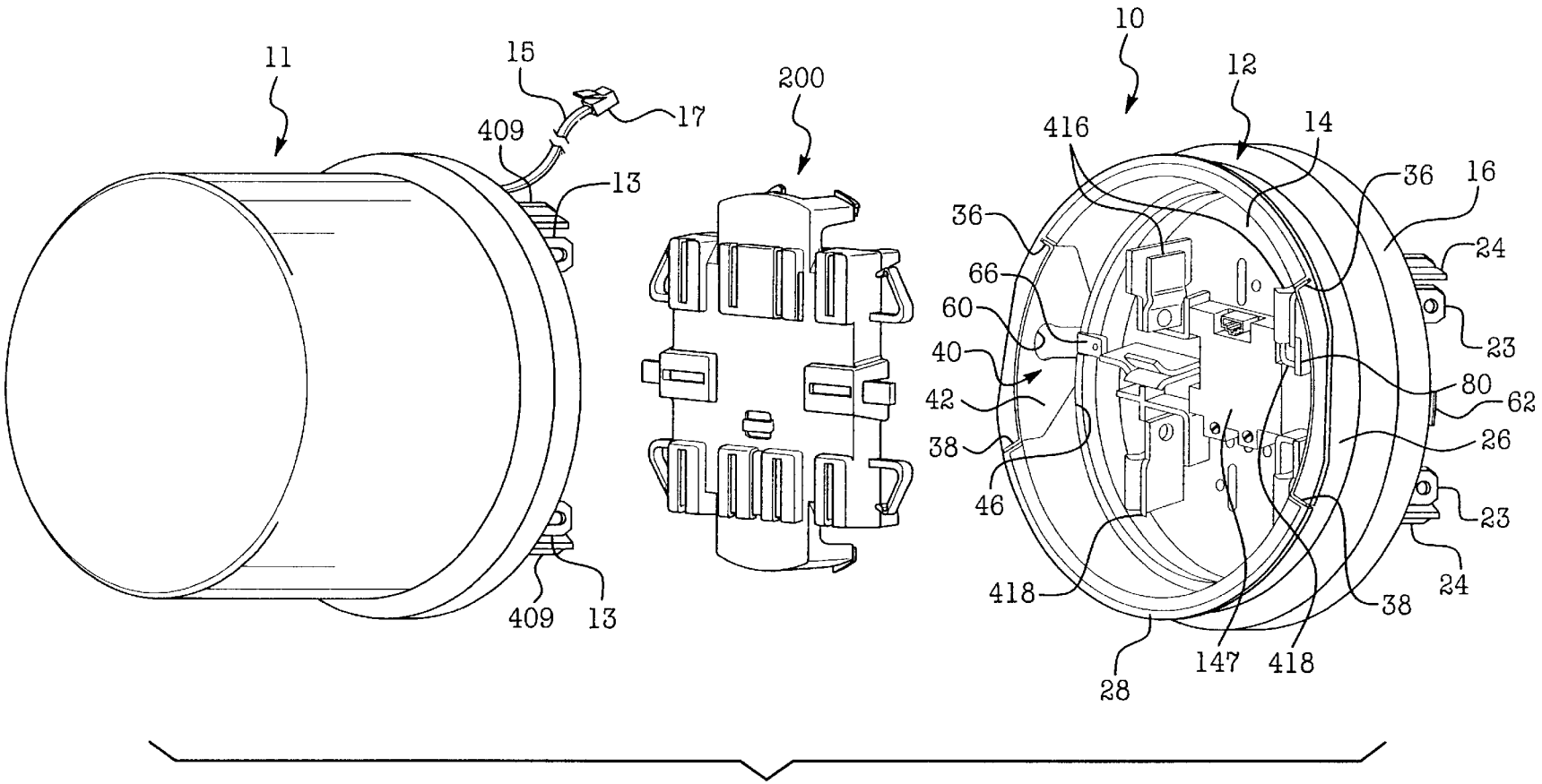
FIG. 1 is an exploded perspective view showing a safety shield constructed according to the teaching of the present invention mountable in a watthour meter socket adapter devised for receiving a watthour meter.

A conventional socket adapter 10 includes contacts designed to receive blade terminals 13 of a conventional electric watthour meter 11 in a releasible connection. The socket adapter 10 also includes terminals 23, described hereafter, which plug into mating contacts in a watthour meter socket, not shown. The number of contacts and terminals in the socket adapter 10 will vary depending upon the type of electric service at a particular user site, FIG. 1 depicts, by way of example only, a single phase electric service. Preferably, the socket adapter 10 includes a housing 12 which is integrally molded from a suitable electrically insulating material, such as polycarbonate.

The housing 12 includes a base 14 with a peripheral flange 16. A plurality of apertures 18, are formed in the base 14 by convention, at the jaw contact positions in a socket adapter 10. Mounting feet 24 extend from the outer surface of the base 14 and are disposed adjacent to the blade terminals 23.

An annular sidewall 26 extends from the base 14 to an outer meter mounting flange 28. The height or length of the sidewall 26 is substantially shorter than in previously devised socket adapters to provide a low profile to the socket adapter 10.

Figure 2:
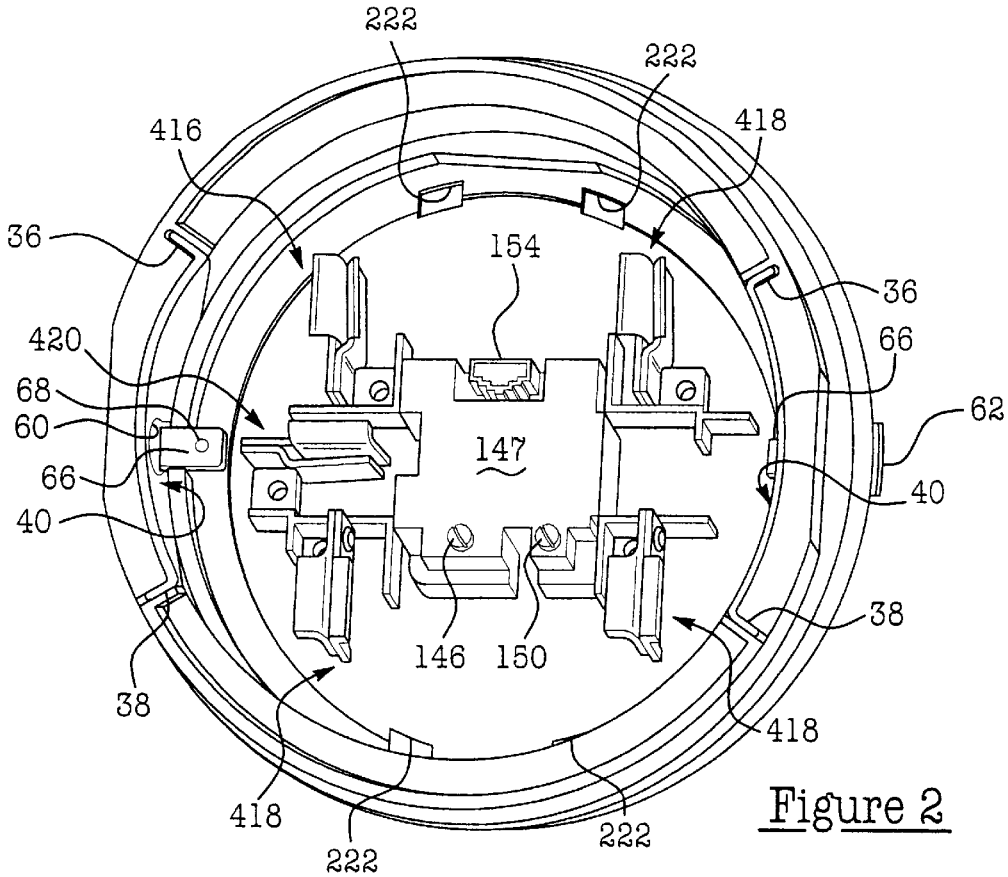
FIG. 2 is a perspective view of the socket adapter shown in FIG. 1 which receives the safety shield of the present invention.

The socket adapter 10 also has a ground surge means mounted therein. As shown in FIGS. 1 and 2, at least one pair of slots 36 and 38 are formed in the mounting flange 28. The slots 36 and 38 are spaced apart on the mounting flange 28 and extend from an inner edge of the mounting flange 28 at the juncture of the inner surface of the mounting flange 28 and the sidewall 26 to a termination short of the peripheral edge of the mounting flange 28. In a preferred embodiment, two pairs of slots 36 and 38 are formed on the mounting flange 28, each pair of slots 36 and 38 generally diametrically opposed from the other pair of slots 36 and 38 as shown in FIGS. 1 and 2.

At least one and preferably two identical surge ground conductors 40 are diametrically mounted opposite each other on the mounting flange 28. Each surge ground conductor 40 is removably mounted in one pair of slots 36 and 38 and includes an arcuate wall portion 42 which conforms to the inner diameter of the annular sidewall 26 of the housing 12. The arcuate wall portion 42 has an upper edge 44 and a lower edge 46. A pair of radially extending tabs are formed on opposite side ends of the arcuate wall portion 42 generally adjacent the upper edge 44. Each tab has a lower edge which seats in a lower portion of one of the slots 36 and 38 on the mounting flange 28. Each tab has an upper edge extending at an angle away from a planar lower edge to dispose the top edge 44 of each surge ground conductor 40 slightly above the upper edge of the mounting flange 28. This places the upper edge of each surge ground conductor 40 at a position to electrically engage a ground terminal mounted on the rear surface of a conventional watthour meter.

Each surge ground conductor 40, as shown in FIGS. 1 and 2, has a cutout 60 formed in the lower edge 46. As described in U.S. Pat. No. 5,997,345, the contents of which are incorporated herein in its entirety, a movable mounting foot or tab 62 is pivotally connected by fingers to the lower edge 46 of the arcuate wall portion 42. The mounting foot 62 has a generally planar shape. Opposite from the mounting foot and contiguous therewith is a second planar portion or flange 66 having an optional aperture 68 formed therein.

In an initial, premounted state, the mounting foot and contiguous flange 66 are generally in-line with the annular sidewall 42 of each surge ground conductor 40. The mounting foot is designed to be slidably inserted through an aperture formed at the juncture of the base 14 and the annular sidewall 26 of the socket adapter housing 12. Two slots are diametrically formed in the housing 12. One mounting foot is inserted through one slot after being bent generally perpendicular to the annular sidewall 42 until the foot is disposed in proximity with the base 14 of the housing 12 to securely attach each surge ground conductor 40 to the housing 12.

At the same time, the pivotal or bending movement of the mounting foot also causes a pivotal movement of the flange 66 to a radially inward extending position within the housing 12. In this position, the flange 66 is located to provide an easy connection with an electrical conductor to connect the electrical conductor to the surge ground conductor 40.

Further, the flange 66 is preferably configured to receive a slide-on, quick connector attached to one end of an electrical conductor. By use of the integral mounting foot 62, each surge ground conductor 40 may be securely attached to the socket adapter housing 12 without the need for a separate fastener, rivet, etc.

As described in detail in co-pending patent application, Ser. No. 09/418,253 filed Sep. 4, 1998, the contents of which are incorporated herein in its entirety and as shown in FIGS. 1, 3–9, the base 14 of the socket adapter 10 is of generally circular shape. Preferably, the apertures or slots 18 having an elongated, rectangular shape suitable for receiving the blade terminal of a jaw blade assembly as described hereafter.

As best seen in FIG. 1, the outer end of the sidewall 26 terminates in a radially outward extending mounting flange 28 which is adapted for mating with a complementary mounting flange on a watthour meter. The mounting flange 28 is 30 surroundable by a conventional sealing ring, not shown, to sealingly join the watthour meter 11 to the socket adapter 10 in a conventional manner.

For the single phase socket adapter 10 shown in FIGS. 1 and 2, a pair of line jaw blades 416 and a pair of load jaw blades 418 are mounted in the base 14 in the appropriate jaw contact/blade terminal positions for a single phase watthour meter/watthour meter socket application. A similar jaw blade 420 may also be provided at the fifth position.

As each of the line, load and ground or fifth position jaw blades 416, 418 and 420 are substantially identically constructed, the following description of a first embodiment of the jaw blade 416, as shown in FIGS. 4–7, will be understood to apply equally to all line, load and ground jaw blade assemblies.

Figure 5:
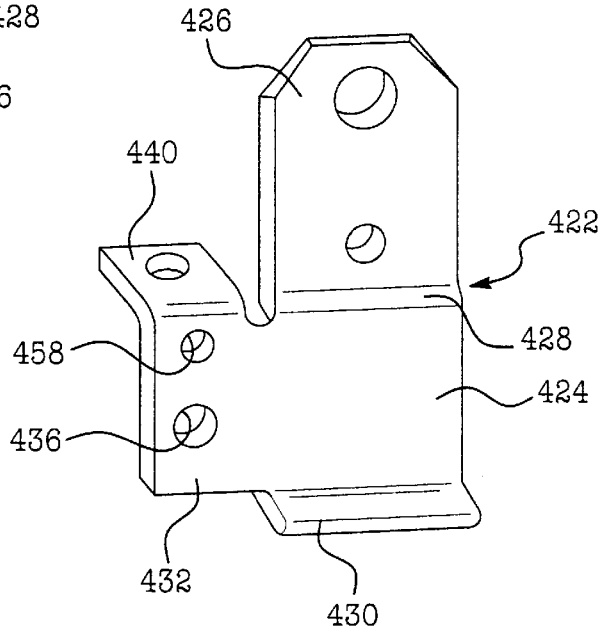
FIG. 5 is a perspective view of the bus bar portion of the jaw blade shown in FIG. 4.

As shown in FIG. 5, the jaw blade 416 includes a one piece, unitary, electrically conductive bus bar 422 which is formed with a jaw end 424 and an opposed blade terminal end 426. The bus bar 422 is formed of an electrically conductive material, such as copper, or plated copper for example. An offset 428 is formed intermediately between the jaw end 424 and the blade terminal end 426 to offset the plane of the jaw end 426 from the plane of the blade terminal end 426.

An angled edge guide 430 is formed along one edge of the jaw end 424 to assist in guiding a watthour meter blade terminal, not shown, into contact with the jaw end 424 as described hereafter. An extension 432 projects unitarily from the jaw end 424 co-planarly with the jaw end 424. The extension 432 serves as a mounting base for a spring clip 434 described in greater detailed hereafter. An aperture 436 is formed in the extension 432 for receiving a fastener, such as a rivet 438, used to mount the spring clip 434 on the bus bar 422.

A tab 440 projects angularly, preferably perpendicularly, from one edge of the extension 432. The tab 440 is positioned intermediate the jaw end 424 and the blade terminal end 426 of the bus bar 422 and also extends generally perpendicularly from the jaw end 424 and the blade terminal end 426. An aperture 442 may be formed in the tab 440 for receiving a fastener, not shown, to secure an auxiliary electrical conductor, not shown, to the tab 440 and jaw blade 416. However, the tab 440 serves a more important mounting function for the jaw blade assembly 416 as described hereafter.

Figure 6:
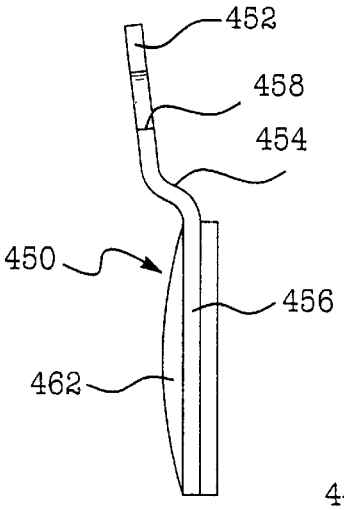
FIG. 6 is a side elevational view of the spring clip shown in FIG. 4.
Figure 7:
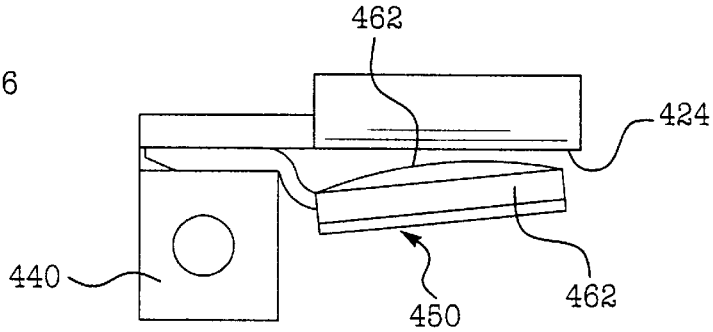
FIG. 7 is a plan elevational view of the assembled jaw blade shown in FIG. 4.

As shown in FIGS. 6 and 7, the jaw blade 416 also includes a spring clip 450 which is formed of a spring or resilient material, such as spring steel. The spring clip 450 includes a base 452 which is connected by an intermediate, offset 454 to a contact end 456.

The base 452 is initially pre-bent from a planar adjacent the offset 454, as shown in FIG. 6. An aperture 458 in the base 452 receives the fastener or rivet 438. Insertion of the rivet 438 through the aperture 458 and the corresponding aperture 436 in the extension 432 on the bus bar 422 bends end of the base 452 into planar, full contact engagement with the extension 432 to apply spring force to the spring clip 450.

The single fastener or rivet 438 can be employed to fixedly mount the spring clip 450 on the bus bar 422 since a centering and locating dimple 458 and mating dome 460 are respectively formed in the bus bar 422 at the juncture between the extension 432 and the tab 440 and on one side edge of the base 452 of the spring clip 450. The engagement of the dimple 458 and the dome 460 locates the spring clip 450 with respect to the bus bar 422 and prevents rotation of the spring clip 450 relative to the bus bar 422 after the rivet 438 is inserted to fixedly attach the spring clip 450 to the bus bar 422.

As shown in FIGS. 6 and 7, the contact end 456 of the spring clip 450 has a generally concave shape with a raised center contact surface 462 facing the adjacent jaw end 424 of the bus bar 422. Since the forced engagement of the rivet 438 with the angled base 452 of the spring clip 450 places a spring force on the spring clip 450 biasing the contact end 456 toward the adjacent jaw end 424, the raised center 462 of the contact end 456 forms an adequate contact surface with a watthour meter blade terminal inserted through a slot 464 formed between the raised center surface 462 of the spring clip 450 and the adjacent face of the jaw end 424 of the bus bar 422.

Figure 3:
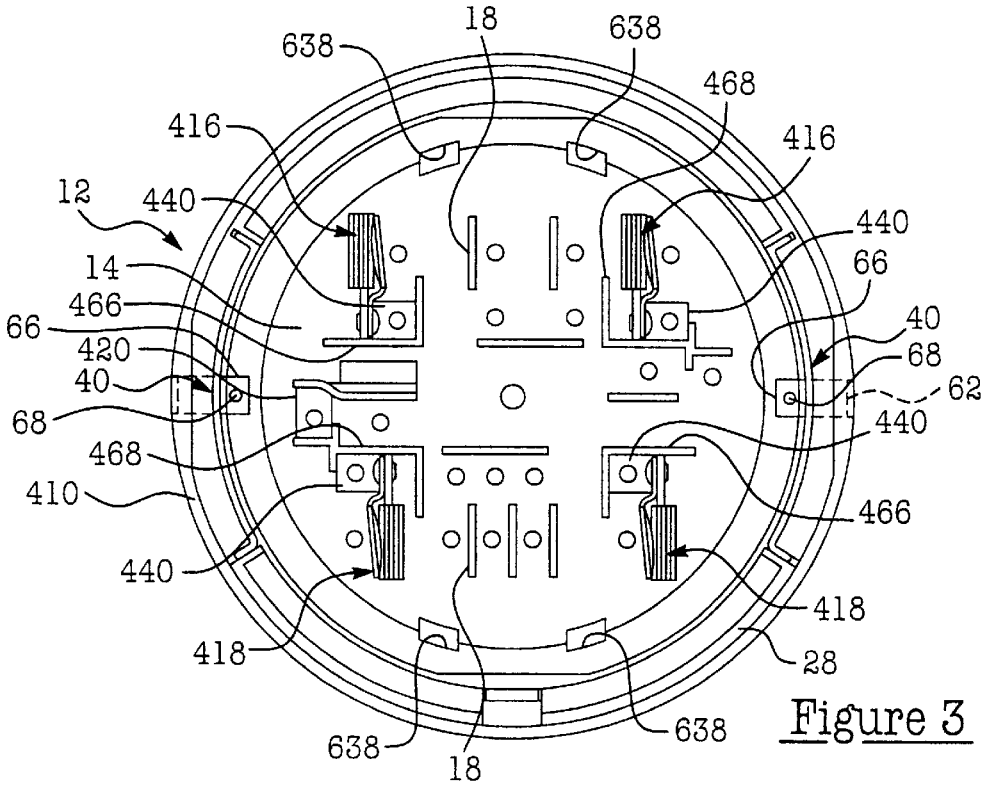
FIG. 3 is a front elevational view of the socket adapter shown in FIG. 2.
Figure 4:
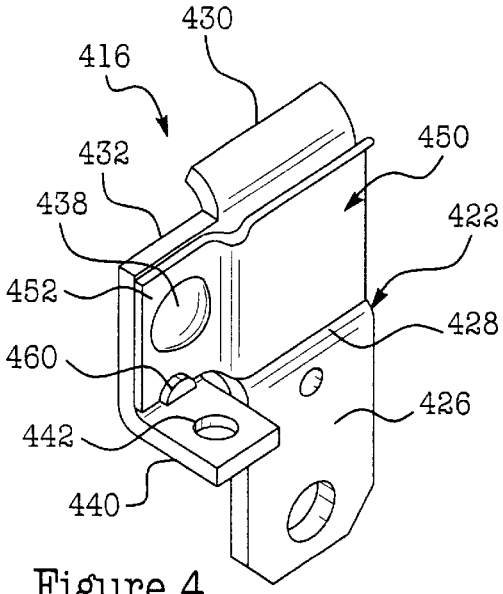
FIG. 4 is an enlarged, perspective view of one of the jaw blades shown in FIGS. 2 and 3.

Referring now to FIG. 3 there is depicted means for electrically isolating each of the line and load jaw blades 416 and 418, as well as the optional jaw blade 420, from each other. The isolating means includes a plurality of irregularly shaped brackets or flanges of two types 466 and 468, by example only. The flanges 466 and 468 are unitarily formed with the base 14 and project upwardly from the base 14 within the interior space formed between the base 14 and the sidewall 26.

The flanges 466 have a generally L-shape and are positioned to engage at least two sides of the mounting tabs 440 on one line jaw blade 416 and one load jaw blade 418. The other flanges 468 have an irregular shape with one pair of perpendicularly oriented surfaces positioned to engage two edges of the tabs 440 on one line jaw blade 416 and one load jaw blade 418. Other portions of the flanges 468 are positioned to engage the tabs 440 on the optional fifth jaw blade 420.

In this manner, when each line and load jaw blade 416 and 418 is inserted through one of the slots 18 in the base 14, the respective tabs 440 will seat on the base 14 and engage the respective flanges 466 and 468. This aids in preventing pivotal movement of each of the line and load jaw blades 416 and 418 in the respective slot 18 in the base 14.

Figure 8:
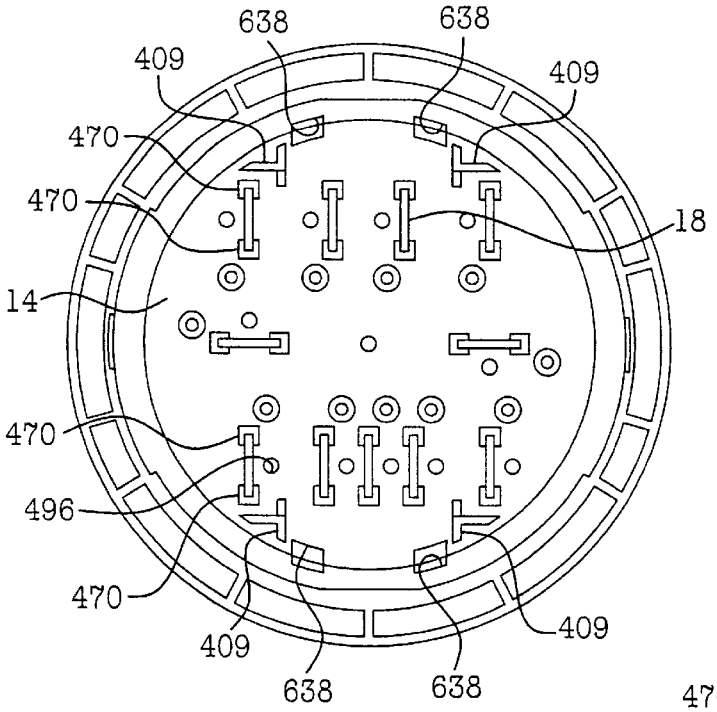
FIG. 8 is a rear elevational view of the socket adapter housing shown in FIGS. 2 and 3.
Figure 9:
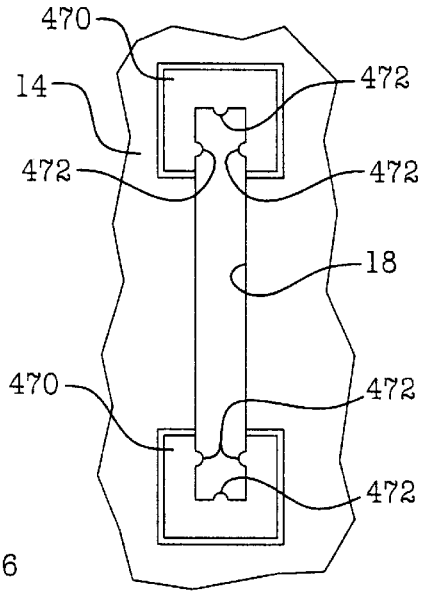
FIG. 9 is an enlarged, partial view of one of the jaw blade mounting apertures depicted in FIG. 8.

FIGS. 8 and 9 depict a rear or exterior surface of the base 14. The mounting means also includes at least one and preferably a pair of opposed U-shaped flanges 470 which are formed on the base wall 14 and disposed on opposite ends of each slot 18. Each U-shape flange 470 is positioned to engage one side edge of the blade terminal end 426 of one line or load jaw blade 416 or 418 to assist in preventing sideways pivotable movement of the jaw blade 416 or 418 in the slot 18.

The mounting means also includes at least one and preferably a plurality of bosses 472, such as three, by example only, which are unitarily formed on the base 14 in opposed ends of each jaw blade mounting slot 18. Each boss 472 extends into the slot 18 and is adapted for engaging the blade terminal end 426 of one line or load jaw blade 416 or 418 to securely fix the blade terminal end 426 in the slot 18 without movement. The bosses 472 are arranged in pairs side edge to side edge of the slot 18 or on opposite sides of the slot 18.

Figure 10:
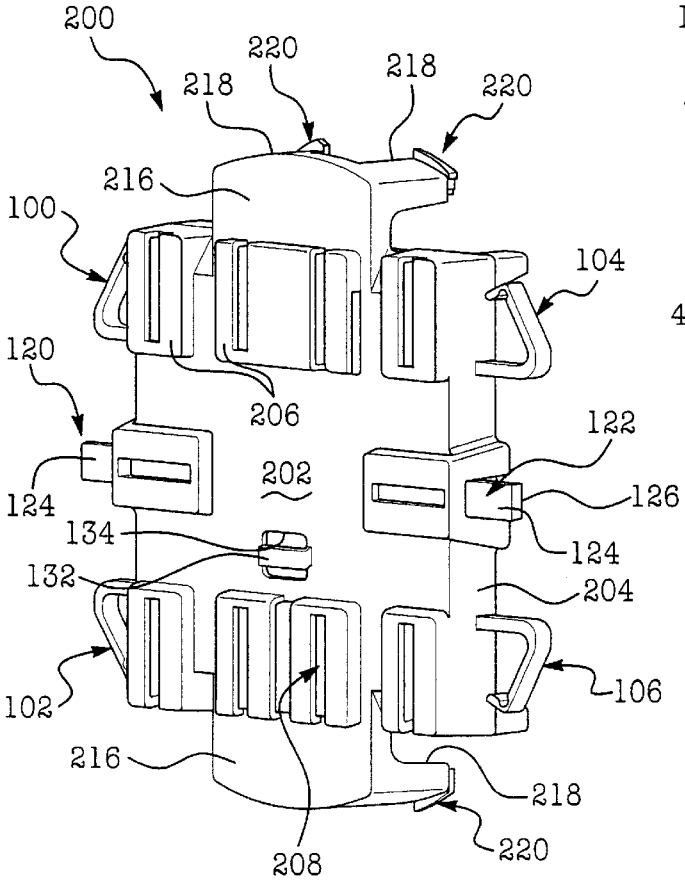
FIG. 10 is a perspective view of the safety shield shown in FIG. 1.
Figure 11:
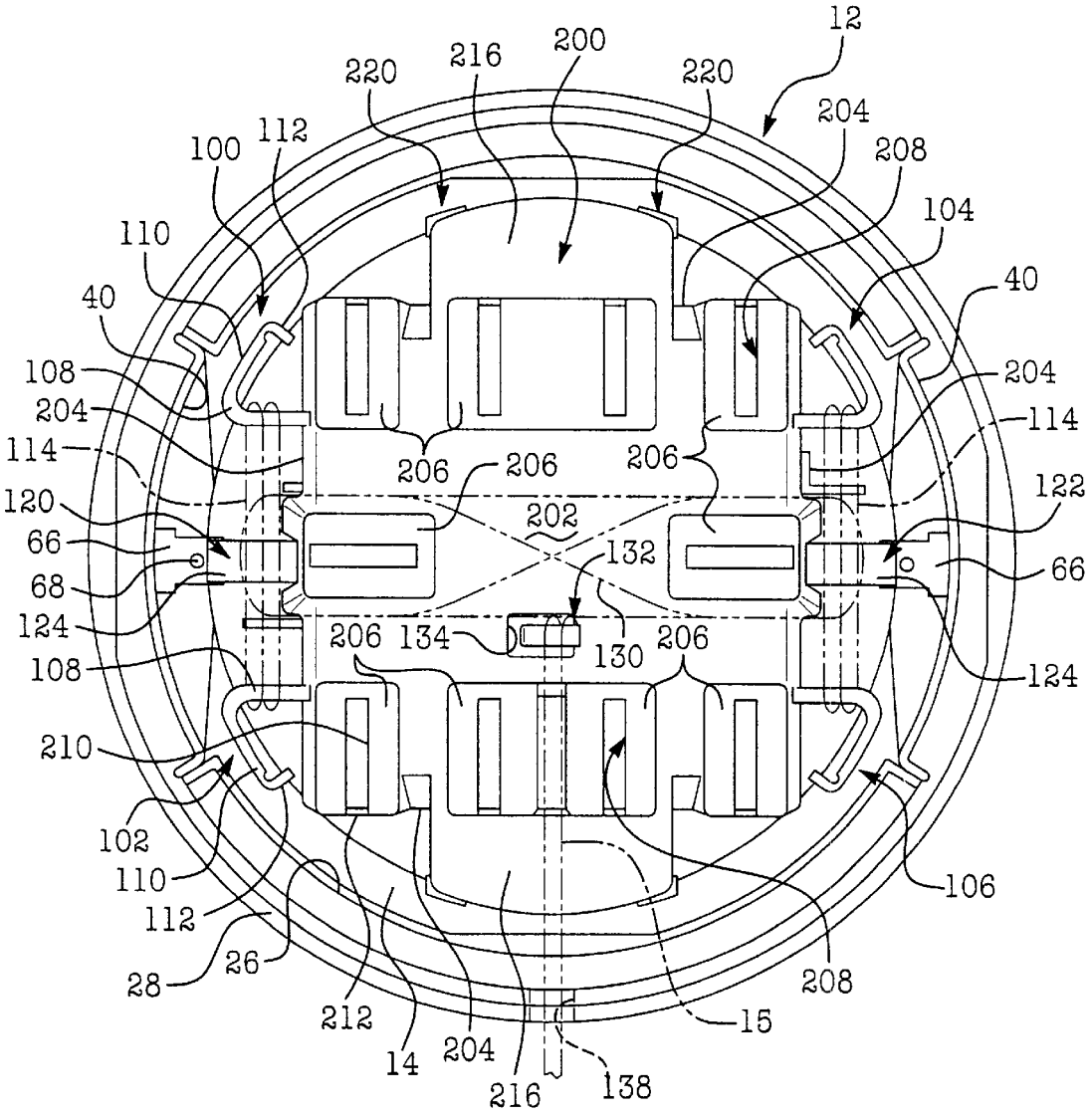
FIG. 11 is a front elevational view of the assembled safety shield and the socket adapter shown in FIG. 1.

Referring now to FIGS. 10–12, there is depicted a jaw contact safety shield 200 which is mountable in the socket adapter housing 12. The safety shield 200 is formed of a one-piece, electrical insulating material, such as a suitable plastic, and, when mounted in the socket adapter housing 12, substantially surrounds all of the line and load jaw blades 416, 418 and the optional jaw blade 420 within the socket adapter 10 and includes small slots allowing the insertion of one watthour meter blade terminal 13 into engagement with each line and load jaw contact 416 and 418 in the socket adapter 10.

The safety shield 200 includes a top or outer wall 202 and a plurality of sidewalls all denoted by reference number 204. A plurality of raised bosses 206 are formed on the top wall 202. The bosses 206 are positioned at the normal jaw contact positions of a watthour meter socket adapter.

Each boss 206 has an aperture or slot 208 formed therein. Each slot 208 has a top wall portion 210 extending parallel to the plane of the top wall 202 and a contiguous sidewall portion 212 forming a continuous L-shaped slot along the top wall 202 and the sidewall 204 of the safety shield 200. The provision of the side slot portion 212 simplifies the insertion or removal of the watthour meter into and out of the jaw contacts in the socket adapter through the safety shield 200.

A plurality of end flanges 216 are formed on opposite edges of the sidewall 204 and project outwardly from each adjacent sidewall 204. Each end flange 216 has a pair of downwardly depending legs 218 extending therefrom, each leg 218 terminating in an outwardly extending latch projection 220. The latch projection 220 in each leg 218 is releasibly insertable through one aperture 222 in the base wall 14 of the socket adapter housing 12 as shown in FIGS. 12A–12D.

Figure 12A:
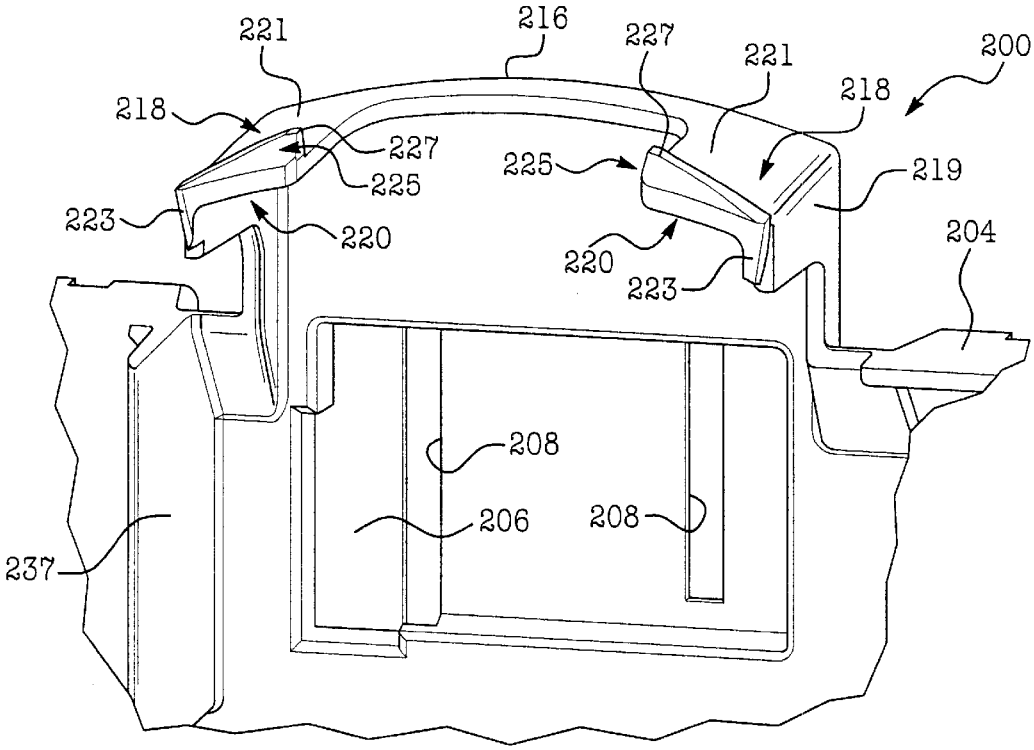
FIG. 12A is a partial, rear perspective view of the safety shield of the present invention.

Each leg 218 is formed of first and second angularly disposed leg portions 219 and 221, respectively, as shown in FIG. 12A. The first leg portion 219 terminates in a first free edge 223. The second leg portion 221 extends angularly from a common edge with the first leg portion 219, preferably at a 90° angle. The second leg portion 221 terminates in a flange 225 having a cantilered edge projecting from an end of the flange 225 common with one end of the second leg portion 221.

As shown in FIG. 12A, the flange edge 27 has a generally tapered shape extending between one end portion at the joint of the first and second leg portions 219 and 221 to a larger diameter end at the inner end of the second leg portion 221.

Since the entire safety shield 200 is formed of a plastic material, the length of the legs 218 as well as the thin nature of the flange 225 provides a degree of springiness or resiliency to the flange 225 and the end of the second leg portion 221 which enables the flange 225 to exhibit twisting movement as described hereafter.

Figure 12B:
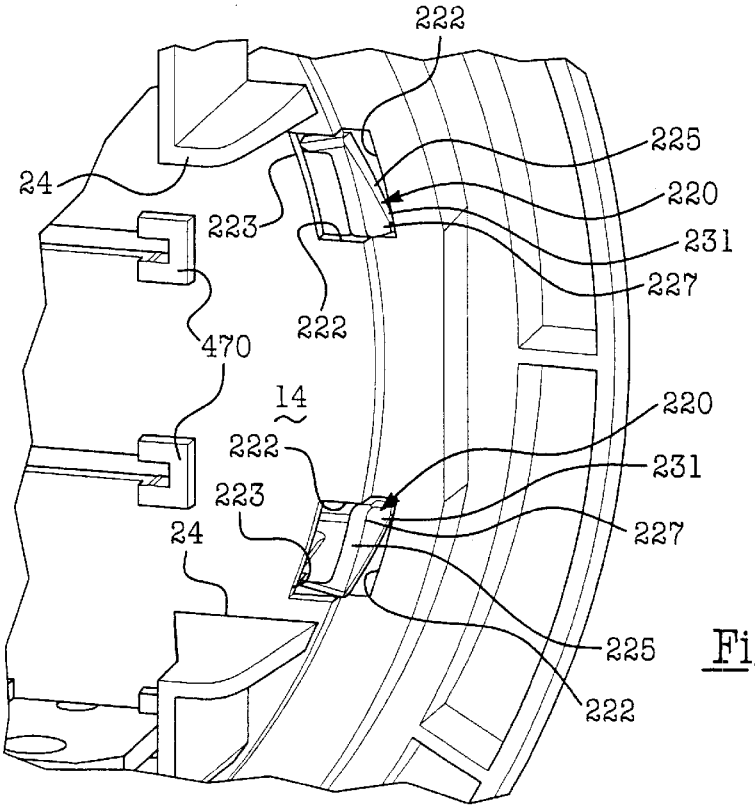
FIG. 12B is a partial, rear perspective view showing the mounting legs of the safety shield in a latched position in the watthour meter socket adapter base.

As shown on FIGS. 12B–12D, the second leg portion 221 will exhibit a degree of twisting movement as each leg 218 of the shield 220 is forcibly inserted through one of the apertures 222 in the base wall 14 of the socket adapter housing 12. The legs 218 are inserted through the apertures 222 until the flanges 225 snap over the edge of the base wall 14 surrounding the aperture 222. In this position, as shown on FIGS. 12B and 12C, the flange edge 227 overlays and is in an engagement with a surface 231 defined by a recessed portion of the base wall 14 within the aperture 222. At the same time, the edge 223 of the first leg portion 219 of each leg 218 is in engagement with an inner edge 233 of the aperture 222.

In this manner, the edge 223 locks the leg 218 in the aperture 222 from movement at least along the length of the edge 223 which completely fills the inner dimension of the aperture 222 extending from the edge 233. Only the edge 227 of the flange 225 is capable of movement, such as a bending or twisting movement, about the juncture of the edge 223 of the first leg portion 219 and the flange 225 on the end of the second leg portion 221. Force exerted in the direction of arrow 235, shown in FIG. 12D, will result in a twisting or bending movement of the edge 227 of the flange 225 until the flange 225 clears the surface 231 thereby enabling the entire leg 218 to be separated from the aperture 222.

The combination of the complete filing of the width of the aperture 225 by the edge portion 223 of the first leg portion 219 of each leg 218 as well as the snap-over engagement of the flange 225 on the second leg portion 221 of each leg 218 locks the safety shield 200 to the base wall 14 of the socket adapter housing 12. This locking resists separation of the legs 218 of the safety shield 200 from the base wall 14 during removal of a watthour meter through the apertures in the shield. At the same time, however, once the socket adapter housing 12 has been separated from the watthour meter socket, bending force in the direction of arrow 235 in FIG. 12D may be employed to release each leg 218 from the base wall 14 to separate the safety shield 200 from the base wall 14.

Another aspect of the present invention is also shown in FIG. 12A. An electrically insulating barrier, such as a flange 237, integrally formed with and projecting from a rear surface of the safety shield 200, is formed on the safety shield 200 in at least one or more locations, preferably adjacent to an aperture in the safety shield 200 which is adapted to be disposed adjacent the line and load jaw contacts 416 and 418 in the socket adapter housing 12. The insulating barrier 237 electrically isolates the high electric potential jaw contacts from any adjacent circuitry or components mounted within the socket adapter housing and covered by the safety shield 200.

As shown in FIGS. 10 and 11 there is depicted a wire guide or wire wrap means formed integrally on the safety shield 200 for providing a winding surface for the cables or conductors 15 attached to the watthour meter 11 when the watthour meter 11 is mounted in the socket adapter housing 12.

In one aspect of the safety shield 200, at least one pair of spaced, opposed wire guides 100 and 102 are integrally formed on opposite sidewalls 204 of the safety shield 200, preferably adjacent the sidewalls 204, from which the flanges 216 project. An optional second pair of wire guides 104 and 106 are also formed on the same sidewalls 204, but adjacent the opposed intervening sidewall 204 from which the opposed flange 216 extends.

The wire guides 101, 102, 104, and 106 may take any conventional shape, but are preferably in a hook-like shape to provide a surface or edge about which the watthour meter cable is can be easily wound in a variety of back and forth or crisscross patterns over the safety shield 200. By way of example only, each wire guide 100, 102, 104 and 106 has an arm-like shape formed of a first leg 108 projecting from one sidewall 204 of the safety shield 200, a second leg 110 angularly disposed, preferably at an acute angle, from the first leg 108, and an outer tip 112. The outer tip 112 is disposed at an angle to the second leg 110, preferably at a 90° angle. The outer end of the tip 112 is spaced from the adjacent sidewall 204 of the safety shield 200 to provide an opening for insertion of the watthour meter cable 15 is therethrough.

Preferably, the distance between the end of the tip 112 and the sidewall 204 is smaller than the diameter of the wires or conductors 15. The spring or resilient nature of the arms 100, 102, 104 and 106 enables the tip 112 to move away from the sidewall 204 for insertion of the wire 15 into the interior space defined by the arm and the sidewall 204. However, the tip 112 springs back to trap and hold the wire 15 in the interior space.

As shown by the phantom lines 114, any watthour meter cable or cables 15 can be wound around the first legs 108 of each pair of wire guides 100 and 102, and/or 104 and 106. The second legs 110 and the tips 112 of each wire guide 100, 102, 104 and 106 act as protectors for retaining the wrapped cables 15 in position about the opposed wire guides 100 and 102 or 104 and 106.

It will be noted that this winding arrangement and the position of the wire guides 100, 102, and 104, 106 in opposed pairs on opposite sides of the safety shield 10 disposes the wrapped or wound watthour meter cables 15 outside of the watthour meter blade terminals 13 and meter feet 409 thereby preventing any pinching or breaking of the cable 15 during insertion of the blade terminals 13 of the watthour meter 11 through the slots 208 in the safety shield 200.

The wire guide feature of the present safety shield 200 in another aspect shown in FIGS. 10 and 11 can be embodied in opposed flanges 120 and 122 which project laterally outward from opposed sidewalls 204 of the safety shield 200, generally along the sidewalls 204 extending between the end flanges 216. The flanges 120 and 122 include a leg 124 which projects laterally outward from one of the sidewalls 204 and a depending outer leg or tip 126 which projects angularly from the outer end of the first leg 124, such as generally perpendicular therefrom. The tip 126 functions to retain the wire(s) 15 within the confines of the flanges 120, 122 and the adjoining sidewall 204 of the safety shield 200.

As shown in FIG. 11, the watthour meter cable 15 may be wound in a figure eight and/or oval pattern 130 about the flanges 120 and 122 and the adjacent bosses 206 on the top wall 202 of the safety shield 200. This arrangement ensures that the cable 15 is not disposed in a position which would be pinched or broken by insertion of the watthour meter blade terminals 13 through the slots 208 in the bosses 206 of the safety shield 200.

The wire guide feature of the present invention also, in another aspect, is W the form of one or more clips, each denoted in one aspect by reference number 132 in FIG. 11. The clip 132 is in the form of a flange projecting laterally across the top waft 202 of the safety shield 200 aver an aperture 134 formed in the top wall 202. The aperture 134 extends through the top wall 202 and allows the passage of a telephone wire or cable 15 therethrough. The telephone cable 15 enters the interior of the socket adapter housing 12 through an aperture 138 in the sidewall 26 of the socket adapter housing 12. The telephone cable 15 is Wound in a plurality of turns about the clip 132 which acts as a strain relief for the telephone cable 15.

FIG. 13 depicts another aspect of a clip 140 which includes at least one and preferably two spaced clip members 142 and 144. Each clip member 142 and 144 is formed over a first leg 146 projecting upwards from the top wall 202 of the safety shield 200 and an inward turned top leg 148 which terminates in an inner end 150 facing the inner end 150 of the opposed clip member 142 and 144. A small slot is formed between the opposed inner end 150 for insertion of the cable 15 therethrough, after the cable is shown in FIG. 11 enters the socket adapter housing 12 through the aperture 138 in the sidewall 26. The wire or cable 15 may be wrapped in a number of turns around either clip member 142 or 144 for strain relief purposes before passing between the bosses 206 to an aperture in the top wall 202 of the safety shield 10, such as the aperture 134 shown in FIG. 3.

Figure 14:
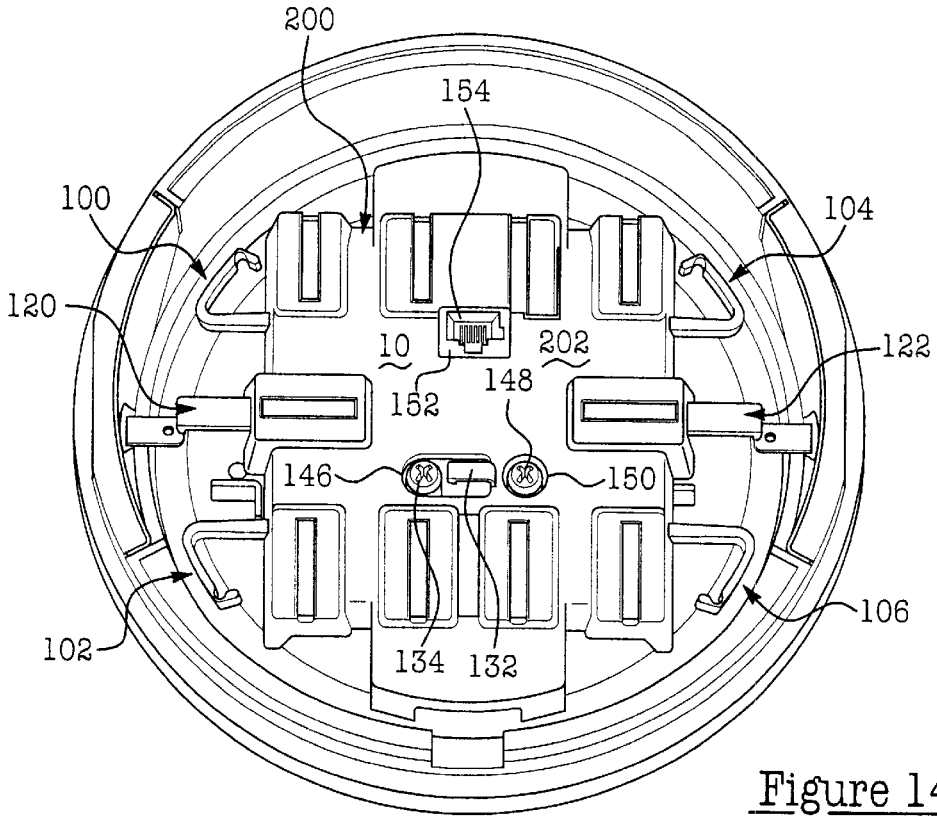
FIG. 14 is a perspective view of another aspect of the watthour meter socket adapter safety shield according to the present invention.

FIG. 14 depicts a modification to the safety shield 200 which, except as described hereafter, has essentially the same construction as the safety shield 200 shown in FIG. 11. Thus, only the differences between the safety shield shown in FIGS. 11 and 13 will now be described in detail.

As shown in FIG. 14, the aperture 134 in the top wall 202 of the safety shield 200 is offset from the longitudinal center of the safety shield 200 thereby providing an enlarged space adjacent one end beyond the end of the clip 132 to provide access to a telephone terminal 146 mounted on a telephone connector 147 on the base 14 of the socket adapter housing 12, as shown in FIGS. 1 and 2. An additional aperture 148 is disposed adjacent to the flange 132 in the top wall 202 of the safety shield 200 and exposes a second telephone terminal 150 on the connector 147. In this manner, the ring and tip wires of a conventional telephone cable 15 extending from the watthour meter 11 may be brought through the aperture 138 in the sidewall 26 of the socket adapter housing 12 as shown in FIG. 11 and then individually secured to the terminals 146 and 150 without removing the safety shield 10 from the socket adapter housing 12.

In addition, an aperture 152 is also formed in the top wall 202 and exposes or receives a conventional telephone jack 154 in the connector 147 for receiving a mating telephone connector 17 on the cable 15 extending from the watthour meter 11. This arrangement simplifies the connection of the telephone cable 15 extending from the watthour meter 11 by enabling the socket connections to the telephone terminals 146 and 150 to be made prior to mounting the watthour meter 11 in the socket adapter housing 12. In addition, as the watthour meter 11 is brought into proximity with the socket adapter 12, the telephone connector 17 on the cable is extending outward from the watthour meter 10 may be easily plugged into the jack 154 and the excess telephone cable 15 wrapped about the clip 132 or any of the other wire guides 100, 102, 104 and 106 or flanges 120 and 122 to conveniently take up any excess telephone cable 15 without interference with watthour meter blade terminals 13 or the meter feet 409.

Figure 15:
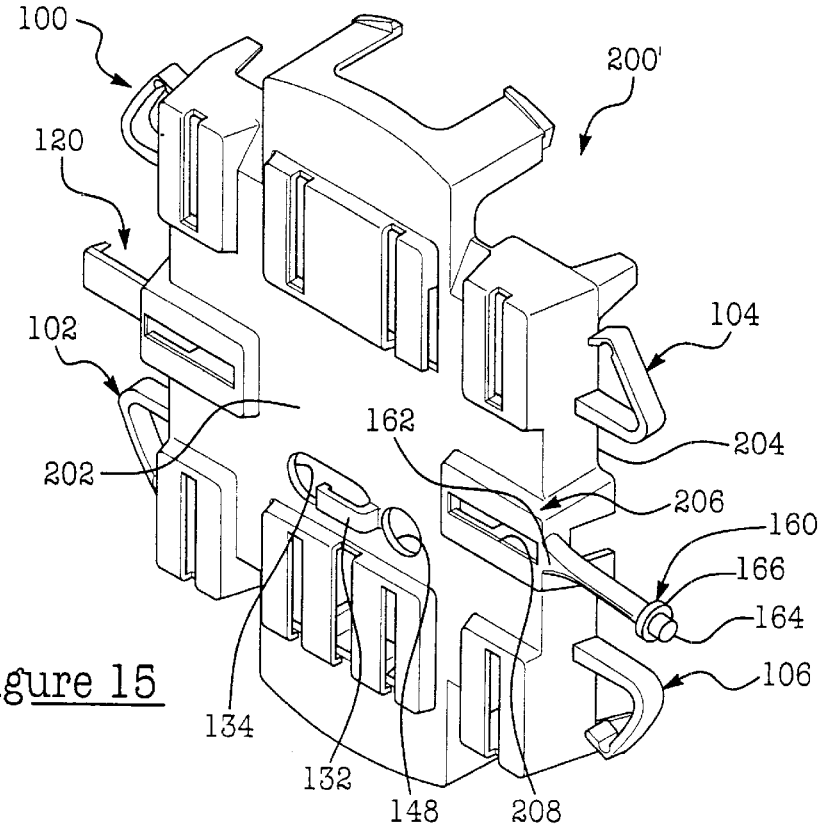
FIG. 15 is a perspective view of yet another aspect of a watthour meter socket adapter safety shield according to the present invention.
Figure 16:
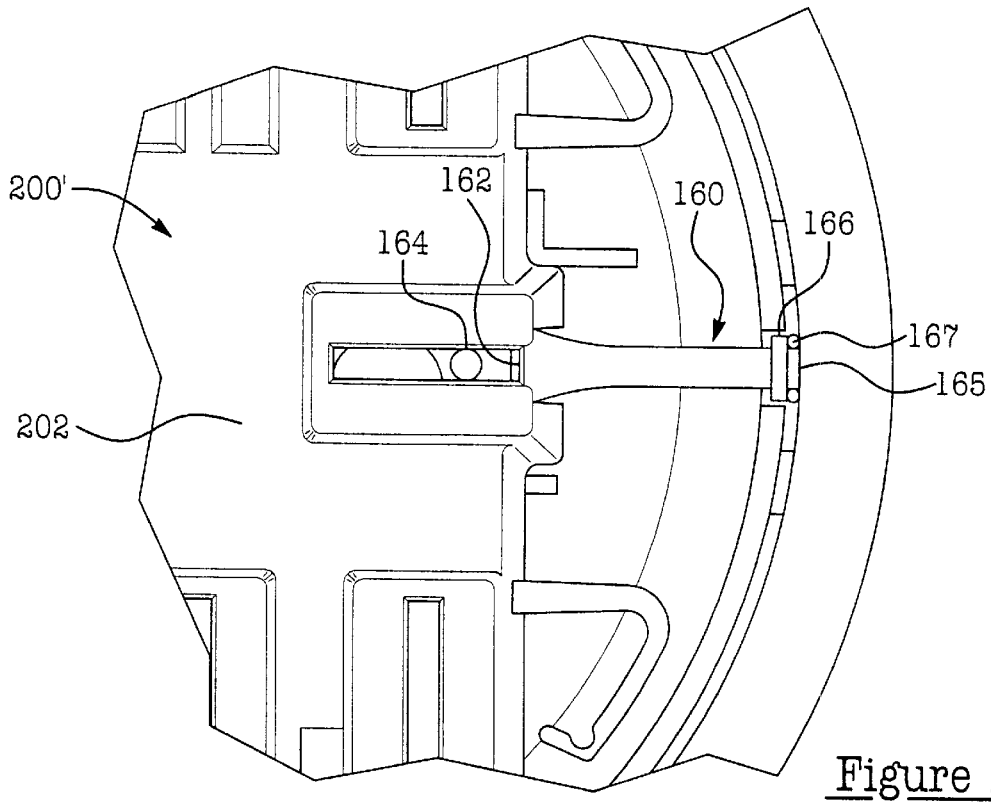
FIG. 16 is a partial, enlarged, front elevational view of the safety shield shown in FIG. 15 mounted in a watthour meter socket adapter.
Figure 17:
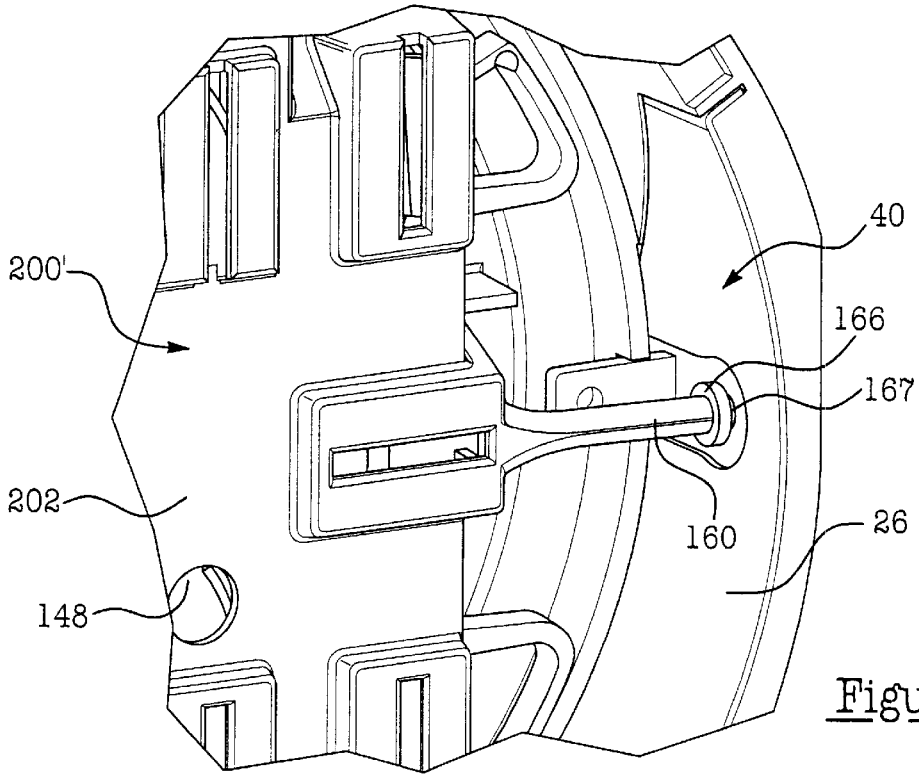
FIG. 17 is a partial perspective view of the safety shield socket adapter shown in FIG. 15.

FIGS. 15, 16 and 17 depict another aspect of a watthour meter safety shield is referred to by the reference number 200'. Due to the substantial number of similar features between the safety shield 200 shown in FIG. 10 and the safety shield 200' shown in FIG. 15, only the differences between of the two safety shields 200 and 200' will be described in detail hereafter.

The safety shield 200' is provided with a light transmitting means or guide, also known as a "light pipe" 160 which guides light generated internally within the socket adapter housing 12, such as by an illuminated light source 164 (FIG. 16) on a circuit element mounted within the socket adapter housing 12 within the confines of the safety shield 200', to an external, more readily visible location, such as the location which is visible externally of the joined watthour meter 11 and the watthour meter socket adapter housing 12. The light pipe 160 is formed of a light transmissive material, such as a transparent, plastic. Preferably, where the entire safety shield 200' is formed of a transparent plastic, the light pipe 160 is integrally molded with the safety shield 200' as a unitary part of the safety shield 200'.

The light pipe 160 has a first light input end 162 which is disposed adjacent the side edge of one slot 208 in one of the bosses 206, such as the boss 206 disposed along one of the sidewalls 204 at the sixth watthour meter jaw contact position. The first end 162 of the light pipe 160 is open or exposed to ambient so as to receive light generated beneath the safety shield 200', such as by an LED 164 shown in FIG. 16 which is mounted on a circuit board carried within the socket adapter housing 12. The light pipe 160 has an output or light discharging end 165. A collar 166, shown by example only, is disposed adjacent to the light discharge end 165 and serves as a seat for a seal member or O-ring 167 which is disposed in proximity to the sidewall 26 of the socket adapter housing 12 as shown in FIGS. 16 and 17.

The collar 166 applies a compressive force on the seal or O-ring 167 to push and hold the seal 167 into sealing engagement with the sidewall 26 surrounding the aperture. In this position, the light discharge end 165 of the light pipe 160 extends exteriorly through or is visible exteriorly through the aperture in the sidewall 26. In this manner, the light discharge end 164 is visible externally of the sidewall 26 of socket adapter housing 12 so as to provide an indication of the illumination state of the illuminated device, such as the LED 164, for whatever function the LED 164 serves in the circuit mounted within the socket adapter housing 12. Examples of such a circuit include a blown or open surge suppression device, a watthour meter tampering indicator, etc.

As also shown in FIG. 17, the light discharge end 165 of the light pipe 160 is disposed through an aperture in the surge ground suppression member 40 so as not to interfere with the function of the surge suppression member.

Although the light pipe 160 replaces one of the intermediate flanges which form the intermediate wire guides 124 and 126, the light pipe 160 can act as a replacement for the wire guide flange 126 by wrapping a cable 15 about the light pipe 126 and the opposed wire guide 124 in the same manner as described above and shown in phantom in FIG. 11.

In summary, there has been disclosed a unique safety shield for use in a watthour meter socket adapter which provides several advantages over previously devised watthour meter socket adapter safety shields. The instant safety shield is provided with unique locking clips on the ends of the mounting legs which securely retain the safety shield in position in the watthour meter socket adapter during removal of a watthour meter from the socket adapter. At the same time, the lock clips are easily disengageable from the back of the socket adapter in order to remove the safety shield from the socket adapter.

The present safety shield is also provided with a unique, integral, wire wrap means which enables elongated cables and conductors extending from a watthour meter to be easily wound up into a small compact shape without exposing the cables or conductors to possible interference and damage or breakage from contact with the watthour meter blade terminals or meter feet.

The safety shield, in another aspect, it is also provided with a light transmissive means or guide which enables the light from light generating elements mounted within the socket adapter housing to be directed to a more easily visible location, such as external of the socket adapter housing, to provide an indication of the occurrence of a circuit event during operation of the watthour meter.

What is claimed is:

1. An electrical power service apparatus having a housing with a base wall and an annular sidewall extending from the base wall, a plurality of electrical contacts mounted on the base wall and adapted for releasibly receiving blade terminals of a watthour meter, the electrical service apparatus comprising: an electrically insulating shield for covering the electrical contacts within the housing, the shield having apertures alignable with at least one electrical contact adapted for receiving a blade terminal of a watthour meter in engagement with the one electrical contact;

a plurality of apertures formed in the base wall of the housing;

a plurality of legs projecting from the shield, each leg having first and second angularly disposed leg portions; and a latch member carried on each leg releasebly engagable with one aperture in the base wall of the housing, the latch member having a free end on the first leg portion and a flange with a cantilevered edge on the second leg portion;

during insertion of the latch member into one aperture in the base wall, the flange camming the edge through the aperture in the base wall by pivoting the second leg portion with respect to the first leg portion until the edge is in engagement with the base wall to latch the shield to the housing; and when latched, the free end of the latch member is substantially engaged with an edge of the aperture in the base wall to prevent unintentional movement of the leg with respect to the aperture in the base wall.

2. The electrical service apparatus of claim 1 further comprising:

four apertures formed in the housing;

four legs carried on the shield, each leg carrying one latch member.

3. The electrical service apparatus of claim 1 wherein the latch member comprises:

a clip having first and second angularly disposed side portions and an edge extending from one of the side portions.

4. An electrical service apparatus having a housing with a base wall and an annular sidewall extending from the base wall, a plurality of electrical contacts mounted on the base wall and adapted for releasibly receiving blade terminals of a watthour meter, the electrical service apparatus comprising;

an electrically insulating shield for covering the electrical contacts within the housing, the shield having apertures alignable with at least one electrical contact adapted for receiving a blade terminal of a watthour meter in engagement with the one electrical contact;

a plurality of apertures formed in the base wall of the housing;

a plurality of legs projecting from the shield;

a latch member carried on each leg releasably engagable with one aperture in the base wall of the housing, each latch member filling one aperture in the base wall of the housing to prevent disengagement of the shield from the housing during removal of the watthour meter from the electrical contacts in the housing; and wire wrap members carried on the shield for receiving wires in a wound condition.

5. The electrical service apparatus of claim 4 wherein the wire wrap members comprise at least one pair of spaced wire wrap members.

6. The electrical service apparatus of claim 5 wherein the at least one pair of wire wrap members are disposed along one sidewall of the shield.

7. The electrical service apparatus of claim 4 wherein the wire wrap members comprise two pair of spaced wire wrap members.

8. The electrical service apparatus of claim 4 wherein at least certain of the wire wrap members comprise:

a surface on the shield for receiving a wound wire.

9. The electrical service apparatus of claim 4 wherein at least certain of the wire wrap members comprise:

a first leg extending outward from the shield; and a second leg extending angularly from one end of the first leg and terminating in a tip, the tip spaced from the shield to define an opening between the first and second legs and the shield for receiving a wire therein.

10. The electrical service apparatus of claim 9 further comprising:

the tip disposed angularly with respect to the second leg.

11. The electrical service apparatus of claim 9 wherein:

the tip is spaced from the shield by a distance less than a diameter of a wire insertable past the tip.

12. The electrical service apparatus of claim 4 wherein at least certain of the wire wrap members comprise:

two spaced flanges extending outwardly from the shield.

13. The electrical service apparatus of claim 12 wherein the two flanges are disposed intermediately on spaced sides of the shield.

14. The electrical service apparatus of claim 12 wherein at least certain of the wire wrap members comprise:

a first leg extending outward from the shield; and a second leg extending angularly from one end of the first leg and terminating in a tip, the tip spaced from the shield to define an opening within the first and second legs and the shield for receiving a wire therein.

15. The electrical service apparatus of claim 4 wherein at least certain of the wire wrap members comprise:

an aperture formed in the socket adapter housing; and a clip carried on the shield and having an end portion extending over the aperture, the clip adapted to receive a wire extending through the aperture in the shield in a wound state.

16. The electrical service apparatus of claim 4 wherein at least certain of the wire wrap members comprise:

first and second arms carried on the shield and spaced apart to define a slot for receiving a wire; and the arms defining a wire winding surface.

17. The electrical service apparatus of claim 4 further comprising:

a light transmissive guide carried on the shield and having first and second ends, the first end adapted to be disposed in proximity with a light generating source in the housing to transmit light generated by the light generating source to the second end, the second end disposed to be a visible externally of the housing.

18. The electrical service apparatus of claim 17 further comprising:

an aperture formed in the sidewall of the housing;

the second end of the light transmissive guide visibly disposed through the aperture in the sidewall of the housing.

19. The electrical service apparatus of claim 17 wherein the light transmissive guide is integrally formed as a unitary, one-piece part of the shield.

20. The electrical service apparatus of claim 1 further comprising:

a light transmissive guide carried on the shield and having first and second ends, the first end adapted to be disposed in proximity with a light generating source in the housing to transmit light generated by the light generating source to the second end, the second end disposed to be visible externally of the housing.

21. The electrical service apparatus of claim 20 wherein the light transmissive guide is integrally formed as a unitary, one-piece part of the shield.

22. The electrical service apparatus of claim 20 further comprising:

an aperture formed in the sidewall of the housing of the socket adapter;

the second end of the light transmissive guide visibly disposed through the aperture in the sidewall of the housing.

23. The electrical service apparatus of claim 22 further comprising:

a seal mounted on the light transmissive guide and engaged with the sidewall of the housing for sealing the aperture in the housing.

24. The electrical service apparatus of claim 23 further comprising:

a collar formed on the light transmissive guide for biasing the seal member into sealing engagement with the sidewall of the housing.

25. An electrical service apparatus having a housing with a base wall and an annular sidewall extending from the base wall, a plurality of electrical contacts mounted on the base wall and adapted for releasibly receiving blade terminals of a watthour meter, the electrical service apparatus comprising:

an electrically insulating shield for covering the electrical contacts within the housing of the watthour meter socket adapter, the shield having apertures alignable with at least one electrical contact adapted for receiving a blade terminal of a watthour meter into engagement with the one electrical contact; and wire wrap members carried on the shield for receiving wires in a wound condition.

26. The electrical service apparatus of claim 25 wherein the wire wrap members comprise at least one pair of spaced wire wrap members.

27. The electrical service apparatus of claim 26 wherein the at least one pair of wire wrap members are disposed along one sidewall of the shield.

28. The electrical service apparatus of claim 25 wherein the wire wrap members comprise two pair of spaced wire wrap members.

29. The electrical service apparatus of claim 25 wherein at least certain of the wire, wrap members comprise:

a surface on the shield for receiving a wound wire.

30. The electrical service apparatus of claim 25 wherein at least certain of the wire wrap members comprise;

a first leg extending outward from the shield; and a second leg extending angularly from one end of the first leg and terminating in a tip, the tip spaced from the shield to define an opening between the first and second legs and the shield for receiving a wire therein.

31. The electrical service apparatus of claim 30 further comprising:

the tip disposed angularly with respect to the second leg.

32. The electrical service apparatus of claim 31 wherein:

the tip is spaced from the shield by a distance less than a diameter of a wire insertable past the tip.

33. The electrical service apparatus of claim 25 wherein at least certain of the wire wrap members comprise:

two spaced flanges extending outwardly from the shield.

34. The electrical service apparatus of claim 33 wherein the pair of flanges are disposed intermediately on spaced sides of the shield.

35. The electrical service apparatus of claim 33 wherein at least certain of the wire wrap members comprise:

a first leg extending outward from the shield; and a second leg extending angularly from one end of the first leg and terminating in a tip, the tip spaced from the shield to define an opening within the first and second legs and the shield for receiving a wire therein.

36. The electrical service apparatus of claim 25 wherein at least certain of the wire wrap members comprises:

an aperture formed in the socket adapter housing; and a clip carried on the shield and having an end portion extending over the aperture, the clip adapted to receive a wire extending through the aperture in the shield in a wound state.

37. The electrical service apparatus of claim 25 wherein at least certain of the wire wrap members comprise:

first and second arms carried on the shield and spaced apart to define a slot for receiving a wire;

the arms defining a wire winding surface.

38. An electrically insulating safety shield for mounting an electrical service apparatus having a housing with a base wall and an annular sidewall extending from the base wall, and a plurality electrical contacts mounted on the base wall and adapted for releasably receiving the blade terminals or a watthour meter, the safety shield comprising:

an electrically insulating body having a top wall and a depending sidewall;

a plurality of apertures formed in the top wall of the body alignable with at least one electrical contact in a housing, the apertures adapted for receiving a blade terminal of a watthour meter therethrough into engagement with the one electrical contact in the housing of the socket adapter; and wire wrap members carried on the body of the safety shield for receiving wires in a wound condition.

39. The safety shield of claim 38 wherein the wire wrap members comprise at least one pair of spaced wire wrap members.

40. The safety shield of claim 39 wherein at least one pair of wire wrap members are disposed along one sidewall of the shield.

41. The safety shield of claim 38 wherein the wire wrap members comprise two pair of spaced wire wrap members.

42. The safety shield of claim 38 wherein at least certain of the wire wrap members comprise:

a surface on the shield for receiving a wound wire.

43. The safety shield of claim 38 wherein at least certain of the wire wrap members comprise:

a first leg extending outward from the shield; and a second leg extending angularly from one end of the first leg and terminating in a tip, the tip spaced from the shield to define an opening between the first and second legs and the shield for receiving a wire therein.

44. The safety shield of claim 43 further comprising:

the tip end disposed angularly with respect to the second leg.

45. The safety shield of claim 43 wherein:

the tip is spaced from the shield by a distance less than a diameter of a wire insertable past the tip.

46. The safety shield of claim 38 wherein at least certain of the wire wrap members comprise:

two spaced flanges extending outwardly from the shield.

47. The safety shield of claim 46 wherein the pair of flanges are disposed intermediate on spaced sides of the shield.

48. The safety shield of claim 46 wherein at least certain of the wire wrap members comprise:

a first leg extending outward from the shield; and a second leg extending angularly from one end of the first leg and terminating in a tip, the tip spaced from the shield to define an opening within the first and second legs and the shield for receiving a wire therein.

49. The safety shield of claim 38 wherein at least certain of the wire wrap members comprise:

an aperture formed in the socket adapter housing; and a clip carried on the shield and having an end portion extending over the aperture, the clip the adapted to receive a wire extending through the aperture in the shield in a wound state.

50. The safety shield of claim 38 wherein at least certain of the wire wrap members comprise:

first and second arms carried on the shield and spaced apart to define a slot for receiving a wire; and the arms defining a wire winding surface.

* * * * *